US007067185B2

(12) United States Patent
Ausen et al.

(10) Patent No.: US 7,067,185 B2
(45) Date of Patent: Jun. 27, 2006

(54) REINFORCED HOOK WEB

(75) Inventors: Ronald W. Ausen, St. Paul, MN (US); Jayshree Seth, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 293 days.

(21) Appl. No.: 10/459,061

(22) Filed: Jun. 11, 2003

(65) Prior Publication Data

US 2004/0253411 A1 Dec. 16, 2004

(51) Int. Cl.
*B32B 3/06* (2006.01)

(52) U.S. Cl. ..... 428/100

(58) Field of Classification Search ..... None
See application file for complete search history.

(56) References Cited

U.S. PATENT DOCUMENTS

| | | | | |
|---|---|---|---|---|
| 3,138,841 | A | 6/1964 | Naimer | |
| 3,266,113 | A | 8/1966 | Flanagan, Jr. | |
| 3,557,413 | A | 1/1971 | Engle | |
| 3,923,442 | A | 12/1975 | Stohr | |
| 4,001,366 | A | 1/1977 | Brumlik | |
| 4,056,593 | A | 11/1977 | de Navas Albareda | |
| 4,189,809 | A | 2/1980 | Sotos | |
| 4,217,327 | A | 8/1980 | Cancio et al. | |
| 4,237,889 | A | 12/1980 | Gobran | |
| 4,290,174 | A | 9/1981 | Kalleberg | |
| 4,454,183 | A | 6/1984 | Wollman | |
| 4,894,060 | A | 1/1990 | Nestegard | |
| 5,315,740 | A | 5/1994 | Provost | |
| 5,537,723 | A | 7/1996 | Yoshida et al. | |
| 5,551,130 | A | 9/1996 | Tominaga et al. | |
| 5,657,517 | A | 8/1997 | Akeno et al. | |
| 5,664,301 | A | 9/1997 | Akeno | |
| 5,839,172 | A | 11/1998 | Takizawa et al. | |
| 5,857,245 | A | 1/1999 | Sakakibara et al. | |
| 6,035,498 | A | 3/2000 | Buzzell et al. | |
| 6,206,679 | B1 | 3/2001 | Provost et al. | |
| 6,209,177 | B1 * | 4/2001 | Murasaki | 24/452 |
| 6,367,128 | B1 * | 4/2002 | Galkiewicz et al. | 24/585.1 |
| 6,399,710 | B1 * | 6/2002 | Finerman et al. | 525/232 |
| 6,484,371 | B1 * | 11/2002 | Romanko et al. | 24/306 |
| 6,687,962 | B1 * | 2/2004 | Clarner et al. | 24/452 |
| 2003/0145440 | A1 | 8/2003 | Ausen et al. | |
| 2003/0215611 | A1 * | 11/2003 | Seth et al. | 428/169 |
| 2004/0170792 | A1 * | 9/2004 | Roberts | 428/40.1 |
| 2004/0170801 | A1 * | 9/2004 | Seth et al. | 428/100 |

* cited by examiner

*Primary Examiner*—Colleen P. Cooke
*Assistant Examiner*—Paul Wartalowicz
(74) *Attorney, Agent, or Firm*—William J. Bond

(57) ABSTRACT

A unitary fastener of a thermoplastic resin comprising a base film layer having generally parallel upper and lower major surfaces, arranged in a first direction the base film layer being oriented at least in the first direction. The backing layer having on at least one surface separated surface elements extending at an angle to said first direction. The invention is also related to a method of forming a unitary fastener. The method includes the steps of extruding a thermoplastic resin in a machine direction through a die plate having a continuous base portion cavity and one or more rib cavities extending from the base portion cavity, forming a strip having a base layer and continuous rib. This scoring or cutting the ribs and at least a surface layer of the film structure forms predetermined separable elements. This inelastically stretching the strip to separated projections and the separated separable surface elements across the strip. The spacings between adjacent separated separable surface elements comprises an oriented film.

27 Claims, 1 Drawing Sheet

REINFORCED HOOK WEB

BACKGROUND OF THE INVENTION

The present invention concerns molded hook fasteners for use with hook and loop fasteners.

BACKGROUND OF THE INVENTION

There are a variety of methods known to form hook materials for hook and loop fasteners. One of the first manufacturing methods for forming hooks involved weaving loops of monofilaments into a fibrous or film backing or the like followed by cutting the filament loops to form hooks. These monofilament loops were also heated to form headed structures such as disclosed in U.S. Pat. Nos. 4,290,174; 3,138,841 or 4,454,183. These woven hooks are generally durable and work well for repeated uses. However, they are generally expensive and coarse to the touch.

For use in disposable garments and the like, it was generally desirable to provide hooks that were inexpensive and less abrasive. For these uses and the like, the solution was generally the use of continuous extrusion methods that simultaneously formed the backing and the hook elements, or precursors to the hook elements. With direct extrusion molding formation of the hook elements, see for example U.S. Pat. No. 5,315,740, the hook elements must continuously taper from the backing to the hook tip to allow the hook elements to be pulled from the molding surface. This generally inherently limits the individual hooks to those capable of engaging only in a single direction while also limiting the strength of the engaging head portion of the hook element.

An alternative direct molding process is proposed, for example, in U.S. Pat. No. 4,894,060, which permits the formation of hook elements without these limitations. Instead of the hook elements being formed as a negative of a cavity on a molding surface, the basic hook cross-section is formed by a profiled extrusion die. The die simultaneously extrudes the film backing and rib structures. The individual hook elements are then formed from the ribs by cutting the ribs transversely followed by stretching the extruded strip in the direction of the ribs. The backing elongates but the cut rib sections remain substantially unchanged. This causes the individual cut sections of the ribs to separate from each from the other in the direction of elongation forming discrete hook elements. Alternatively, using this same type extrusion process, sections of the rib structures can be milled out to form discrete hook elements. With this profile extrusion, the basic hook cross section or profile is only limited by the die shape and hooks can be formed that extend in two directions and have hook head portions that need not taper to allow extraction from a molding surface. This profile extrusion is extremely advantageous in providing higher performing and more functionably versatile hook structures. However, a limitation with this method of manufacture is that the orientation of the film backing to form the hook elements results in decreased tear resistance of the hook in the direction of orientation, which generally is the direction of the ribs. As such, there is a need to improve this process so as to allow for production of hook elements where the backing has increased tear resistance.

BRIEF DESCRIPTIONS OF THE INVENTION

The present invention provides a method for forming preferably a unitary polymeric fastener comprising a thin, strong flexible backing, and a multiplicity of rows of spaced hook or projection members projecting from the upper surface of the unitary backing. The method of the invention generally can also be used to form rows of upstanding projections, which may or may not be hook members that project upwardly from the surface of a unitary film backing, of at least a uniaxially oriented polymer. Preferably, the hook members each comprise a stem portion attached at one end to the backing, and a head portion adjacent the end of the stem portion opposite the backing. The head portion can also extend from a side of a stem portion or be omitted entirely to form alternative projections which can be other forms than a hook member. For hook members, the head portion preferably projects past the stem portion on at least one of two opposite sides. The polymer film backing is oriented at least in the direction of the hook rows. The opposite face of the backing has a series of continuous or intermittent rib structures that intersect the hook rows and the direction of orientation of the film backing.

The fastener is preferably made by a novel adaptation of a known method of making hook fasteners as described, for example, in U.S. Pat. Nos. 3,266,113; 3,557,413; 4,001,366; 4,056,593; 4,189,809 and 4,894,060 or alternatively 6,209,177, the substance of which are incorporated by reference in their entirety. The preferred method generally includes extruding a thermoplastic resin through a die plate which die plate is shaped to form a base layer and spaced ridges, ribs or hook elements projecting above a surface of the base layer. These ridges generally form the cross-section shapes of the desired projection to be produced, which is preferably a hook member. When the die forms the spaced ridges or ribs the cross sectional shape of the hook members or projections are formed by the die plate while the initial hook member thickness is formed by transversely cutting the ridges at spaced locations along their lengths to form discrete cut portions of the ridges. Further, in the invention method the opposite face of the backing has predetermined surface elements which are formed by scoring or cutting the continuous film backing creating separable surface elements. Subsequently, at least longitudinal stretching of the film backing layer (in the direction of the ribs or ridges or in the machine direction) separates these cut portions of the ridges, which cut portions then forms spaced apart hook members and also separates the plurality of separable elements forming separated surface elements which surface elements can be in the form of ribs or mesh type structures creating spacing, recesses or lands between the separated surface elements of an oriented film such that the resultant film backing has different film properties than a flat oriented film backing. The separable surface elements have different orientation properties than the spacings between them after stretching.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENT

Figure 1:
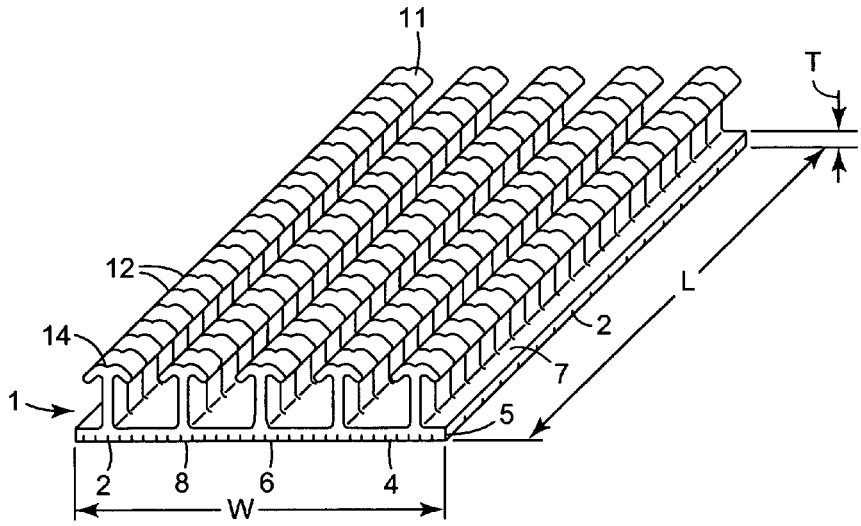
FIG. 1 is a perspective top view of a precursor embodiment of a hook structure of the invention having separable surface elements.

A preferred method for forming the fastener portion generally includes first extruding a strip of thermoplastic resin from an extruder through a die having an opening cut, for example, by electron discharge machining, shaped to form the strip with a base and elongate spaced ribs or ridges 14 projecting above an upper surface 7 of the base layer that have the cross sectional shape of the projections, hook portions or members to be formed. The strip is pulled around rollers through a quench tank filled with a cooling liquid (e.g., water), after which the ribs 14 and possibly the base layer are transversely slit or cut at spaced locations along their lengths by a cutter to form discrete portions 11 of the ribs having lengths corresponding to about the desired thicknesses of the hook portions to be formed, as is shown in FIG. 1. The cut can be at any desired angle, generally from 90° to 30° from the lengthwise extension of the ribs. Optionally, the strip can be stretched prior to cutting to provide further molecular orientation to the polymers forming the ribs and/or reduce the size of the ribs and the resulting hook members formed by slitting of the ribs. Further, optionally, the opposite or lower surface of the backing or base layer 8 is cut in an angle to the ribs, generally to 90 to 10 degrees, preferably 90 to 45 degrees, most preferably 90 degrees. If in cutting the ribs 14 the film base layer is scored, the opposite or lower surface of the backing or base layer need not be cut or scored. However, both faces of the base layer 8 may be cut or scored as described herein. In either case, cutting or scoring of the base layer or film backing creates separable surface elements. The cutter can cut using any conventional means such as reciprocating or rotating blades, lasers, or water jets. Preferably the cutter cuts using blades which for the ridges the cut is preferably oriented at an angle of about 60 to 80 degrees with respect to lengthwise extension of the ribs, more preferably 90 degrees.

After cutting of the ribs and the base layer (on at least one face) 7 or 8, the base layer of the strip is longitudinally stretched in a first direction (L as shown in FIG. 1) at a stretch ratio of at least 2 to 1, and preferably at a stretch ratio of about 4 to 1, preferably between a first pair of nip rollers and a second pair of nip rollers driven at different surface speeds. Optionally, the strip can also be transversely stretched to provide biaxial orientation to the base layer. Stretching provides spaces between the cut portions of the ribs, which then become the projections or hook portions or members for the completed hook fastener.

The stretching process further generates a plurality of separable surface elements which are separated by stretching the base layer or film backing. The strip may be stretched along two, or more than two directions, and to unequal extents in either direction, depending on the specific performance desired in the final fastener. When stretched in more than one direction, stretching in different directions may be carried out either simultaneously or sequentially. Furthermore, the base or film backing may be stretched with interspersed operations. For example, the film backing may be stretched in one or more directions, then treated with a desirable treatment (such as heating, annealing or simply waiting), and then stretched again either in the same direction or in a different direction. Any manner of stretching may be used as long as it helps to create a desirable separation of the projections or hook elements and the separable surface elements as described herein.

Figure 2:
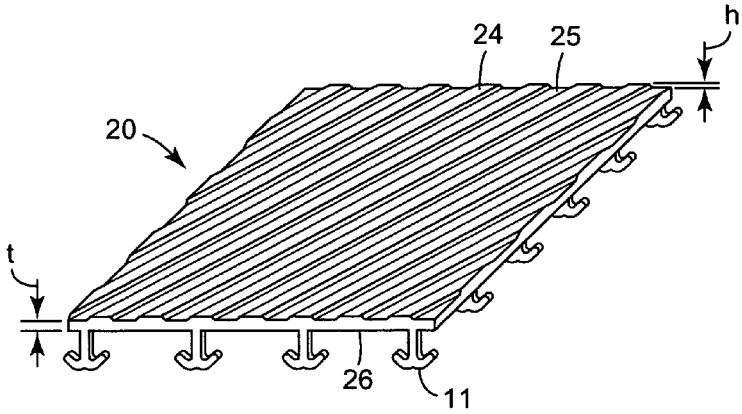
FIG. 2 is a bottom view of the FIG. 1 embodiment hook structure of the invention after is has been stretched to form hook elements and surface elements.

FIGS. 1 and 2 show a perspective view of an embodiment of a strip 1 prior to stretching. The strip 1 has a first dimension (width "W"), a second dimension (length—as illustrated by "L" in FIG. 1) and a third dimension (thickness—as illustrated by "T" in FIG. 1) wherein the first and the second dimensions are preferably much greater than the third dimension. Either the first or second dimension could be an indefinite continuous extension. The strip 1 has a stretchable base layer 5 on film backing 6.

As shown in FIGS. 1 and 2, the film backing 6 and the ribs 14 are scored or cut through from the top and bottom to form scores or cuts 12 and 2, both of which are preferably in a series of parallel lines, which could be continuous or intermittent. There is no requirement for any particular manner or shape of scoring or cutting as long as the cutting generates desired separable surface elements 4 and hook elements 11, although different cutting mechanisms may have different efficiency or productivity. A blade cutter was used in the examples described herein, but any conventional method such as laser ablation or embossing may be used to sever the film layer into separable surface elements. Furthermore, there is no requirement for any particular shape or relative size of the separable surface elements 4 or projection or hook elements 11 as long as the final fastener 20 (strip film) has the desired tear properties or other desired properties.

In a preferred embodiment as shown in FIGS. 1 and 2, the film backing 6 is scored or cut in a series of parallel cut lines 12 in one direction on a first surface 7 to form the separable hook element 11 in the rib structure, and a second series of parallel cut lines 2 in a second direction on a second surface 8 of the film backing 6 to form separable surface elements 4. The parallel cut lines can be linear or nonlinear and continuous or noncontinuous and regular or variable. The direction can be parallel or at angles to each other so that they overlap. The separable surface elements 4 when separated form surface elements 24 arranged in lines that increase the tear resistance for the film backing in the direction of the hook rows. The size of the surface elements 24 formed depends on the spacing of the cut lines and the degree and direction of orientation or tentering. Generally, the separated surface elements 24 in this embodiment are substantially continuous in a predetermined direction or dimension and have a width of from 100 to 1000 micrometers, preferably from 100 to 500 micrometers where the separated surface elements comprise from about 10 to 90 percentage of the surface area of the stretched film structure, preferably 25 to 50 percent. The height "h" of the surface elements 24 depends on the depth of the scoring or cutting as well as the degree of tentering or orientation. Preferably, the surface elements 24 are 5 to 25 micrometers higher than the surface 25 of the oriented film base layer 26, which base layer has a thickness "t" between the separable elements of 10 to 50 micrometers thick. The film is generally stretched at an angle to the first and/or second direction of the cut lines, of from 10 to 80 degrees.

Suitable orientable amorphous glassy thermoplastic polymers include acetates such as cellulose acetate, cellulose triacetate and cellulose acetate butyrate, acrylics such as poly(methyl methacrylate) and poly(ethyl methacrylate), polystyrenes such as poly(p-styrene) and syndiotactic-polystyrene, and styrene-based copolymers, vinylics such as poly(vinyl chloride), poly(vinylidene chloride), poly(vinylidene fluoride), poly(vinylidine dichloride) and mixtures thereof. Preferred amorphous glassy thermoplastic polymers include cellulose acetate, syndiotactic polystyrene, poly (vinyl chloride), poly(vinylidene chloride), poly(vinylidene fluoride) and poly(vinylidine dichloride).

Suitable orientable semi-crystalline thermoplastic polymers include polyolefin homopolymers such as polyethylene and polypropylene, copolymers of ethylene, propylene and/or 1-butylene; copolymers containing ethylene such as ethylene vinyl acetate and ethylene acrylic acid; polyesters such as poly(ethylene terephthalate), polyethylene butyrate and polyethylene napthalate; polyamides such as poly(hexamethylene adipamide); polyurethanes; polycarbonates; poly (vinyl alcohol); ketones such as polyetheretherketone; polyphenylene sulfide; and mixtures thereof. Preferred orientable semi-crystalline polymers include polyethylene, polypropylene, poly(ethylene/propylene), poly(ethylene/1-butylene), poly(propylene/1-butylene), poly(ethylene/propylene/1-butylene), poly(ethylene terephthalate), poly(ethylene butyrate), poly(ethylene napthalate), and mixtures thereof. Particularly preferred are linear low density polyethylene, high density polyethylene, ultra high molecular weight polyethylene, isotactic polypropylene, blends of isotactic polypropylene and substantially syndiotactic polypropylene and blends of isotactic polypropylene and polyethylene.

The oriented thermoplastic polymer film backing of the invention ranges in thickness from about 2 to about 250 micrometers in the base film area. Preferably, the oriented film backing ranges in thickness from about 5 to about 150 micrometers, and more preferably, from about 10 to about 75 micrometers.

The polymers forming the invention film structure may also contain fillers, plasticizers, colorants, lubricants, processing aids, nucleating agents, antiblocking agents, ultraviolet-light stabilizing agents, and other property modifiers. Typically such materials are added to a polymer before it is made into an oriented film (e.g., in the polymer melt before extrusion into a film). Organic fillers may include organic dyes and resins, as well as organic fibers such as nylon and polyimide fibers. Inorganic fillers may include pigments, fumed silica, calcium carbonate, talc, diatomaceous earth, titanium dioxide, carbon fibers, carbon black, glass beads, glass bubbles, mineral fibers, clay particles, metal particles and the like. Filler may be added in amounts up to about 100 parts per 100 parts of the polymer forming the oriented film. Other additives such as flame retardants, stabilizers, antioxidants, compatibilizers, antimicrobial agents (e.g., zinc oxide), electrical conductors, and thermal conductors (e.g., aluminum oxide, boron nitride, aluminum nitride, and nickel particles) can be blended into the polymer used to form the film in amounts of from about 1 to about 50 volume percent.

In the invention, a layered construction, also known as a multilayered film, may be used as the fastener structure. Such multilayered films include, for example, layers of films that are formed by co-extrusion with one or more other polymers, films coated with another layer, or films laminated or adhered together.

If the cuts are only in one direction on a surface of the film structure, a ribbed pattern is formed in the final oriented film structure as shown in FIGS. 1 and 2. Tandem cutting is possible where multiple cuts are made along parallel directions using multiple cutting stations in order to obtain smaller cut spacing than would be possible with just a single cut in that direction. Multiple cuttings at multiple angles on the surfaces of the film structure would result in other shapes such as triangles and other polygons. It is, therefore, possible to achieve a wide variety of controllable shapes and sizes of the topographical features. Intermittent cutting is also possible in one or more directions resulting in discrete zones capable of elongation surrounded by separable elements. Cutting to different depths with different cuts is also possible.

TEST METHODS

Tear Strength

The tear strength of the webs of the invention was measured using an Elmendorf Tear test per ASTM D 1922. One ply or layer of web was used and 5 replicates were tested and averaged.

COMPARATIVE EXAMPLE C1

A mechanical fastener hook material web was made using conventional profile extrusion apparatus. A polypropylene/polyethylene impact copolymer (C104, 1.3 MFI, Dow Chemical Corp., Midland, Mich.) pigmented with 1% of a $TiO_2$/polypropylene concentrate (15100P, Clariant Corp., Minneapolis, Minn.), was extruded with a 6.35 cm single screw extruder (24:1 L/D) using a barrel temperature profile of 177° C.–232° C.–246° C. and a die temperature of approximately 235° C. The extrudate was extruded vertically downward through a die equipped with a die lip having a rectangular opening cut by electron discharge machining. After being shaped by the die lip, the extrudate was quenched in a water tank at a speed of 6.1 meter/min with the water being maintained at approximately 10° C., producing a precursor profiled web. The web was then advanced through a cutting station where the ribs (but not the base layer) of the extruded profile were transversely cut at an angle of 23 degrees measured from the transverse direction of the web. The spacing of the cuts was 305 microns. After cutting the ribs, the base of the web was longitudinally stretched at a stretch ratio of approximately 3 to 1 between a first pair of nip rolls and a second pair of nip rolls to further separate the individual hook elements to approximately 11 hooks/cm. There were approximately 14 rows of ribs or cut hooks per centimeter. The upper roll of the first pair of nip rolls was heated to 143° C. to soften the web prior to stretching. The general profile of this hook is depicted in FIG. 1.

EXAMPLE 1

A web was prepared as in Comparative Example C1, except the flat bottom surface of the web was score cut prior to cutting the hook side of the web. The uncut precursor web was advanced through a cutting station where the flat bottom surface was score cut to a depth of 125 microns. A series of parallel score cuts were made at an angle of 23 degrees measured from the transverse direction of the sheet. The spacing of the cuts was 610 microns. The sheet was then turned over and advanced through a cutting station where the ribs (but not the base layer) of the extruded profile were transversely cut at an angle of 23 degrees measured from the transverse direction of the web. The spacing of the cuts was 305 microns. After cutting the ribs, the base of the web was longitudinally stretched at a stretch ratio of approximately 3 to 1 between a first pair of nip rolls and a second pair of nip rolls to further separate the individual hook elements to approximately 11 hooks/cm. There were approximately 14 rows of ribs or cut hooks per centimeter. The thickness of the flat base layer was 142 microns. The upper roll of the first pair of nip rolls was heated to 143° C. to soften the web prior to stretching. The general profile of this web is depicted in FIG. 2.

The webs were tested for tear strength using an Elmendorf Tear tester. The areas of the web having increased thickness resulted in significantly higher tear strength of the scored web as compared to an unscored web. As the tear front propagates through the web it encounters local regions of higher thickness and lesser orientation resulting in higher tear strength.

TABLE 1

| Sample | MD Tear strength (grams/ply) |
|---|---|
| C1 | 29 |
| Example 1 | 37 |

We claim:

1. A unitary fastener of a thermoplastic resin comprising a film backing having upper and lower major surfaces, with spaced separated projection members arranged in a row in a first direction on one major surface, the film backing being oriented at least in the first direction, the film backing further having on the opposite one major surface separated continuous surface elements extending at an angle to said first direction.

2. The unitary fastener according to claim 1 wherein the projection members are hook elements.

3. The unitary fastener according to claim 2 wherein the projection members are hook elements extended in rows in said first direction.

4. The unitary fastener according to claim 1 wherein said thermoplastic resin is a semicrystalline polymeric resin.

5. The unitary fastener according to claim 4 wherein said polymeric material comprises polyethylene, polypropylene, polypropylene polyethylene copolymers or blends thereof.

6. The unitary fastener of claim 5 wherein the base layer is oriented in at least two directions.

7. The unitary fastener of claim 5 wherein the oriented base layer has a thickness of from 2 to 250 micrometers.

8. The unitary fastener of claim 5 wherein the oriented base layer and has a thickness of from 10 to 75 micrometers.

9. The unitary fastener of claim 5 wherein at least a portion of the surface elements have a height above the base layer of from 5 to 50 micrometers.

10. The unitary fastener of claim 5 wherein at least some of the surface elements have a width of from 100 to 1000 micrometers.

11. The unitary fastener of claim 1 wherein the surface elements are discrete structures each being isolated from its neighbor.

12. The unitary fastener of claim 1 wherein the surface elements are continuous ribs.

13. The unitary fastener of claim 12 wherein the surface elements are substantially linear ribs.

14. The unitary fastener of claim 12 wherein the surface elements comprise 10 to 90 percent of the surface area of the unitary fastener.

15. The unitary fastener of claim 12 wherein the surface elements comprise 25 to 50 percent of the surface area of the unitary fastener.

16. The unitary fastener of claim 12 wherein at least a portion of the surface elements have a width of from 100 to 500 micrometers.

17. The unitary fastener of claim 12 wherein at least a portion of the surface elements have a width of from 100 to 1000 micrometers.

18. The unitary fastener of claim 1 wherein at least a portion of the surface elements have a height above the base layer of from 5 to 25 micrometers.

19. The unitary fastener of claim 1 wherein the surface elements are from 5 to 25 micrometers high above the base layer and the base layer has a thickness of from 10 to 50 micrometers.

20. The unitary fastener of claim 1 wherein the base layer is an orientable thermoplastic film.

21. The unitary fastener of claim 20 wherein the thermoplastic film is a semicrystalline thermoplastic polymer of amorphous glassy polymer.

22. The unitary fastener of claim 20 wherein the thermoplastic film is semicrystalline polymer selected from linear low density polyethylene, high density polyethylene, ultra high molecular weight polyethylene, isotactic polypropylene, blends of isotactic polypropylene and substantially syndiotactic polypropylene and blends of isotactic polypropylene and polyethylene.

23. The unitary fastener of claim 19 wherein the base layer has a thickness of from 2 to 250 micrometers.

24. The unitary fastener of claim 23 wherein the base layer has a thickness of from 5 to 150 micrometers.

25. The unitary fastener of claim 23 wherein the base layer has a thickness of from 10 to 75 micrometers.

26. The unitary fastener of claim 1 wherein the base layer is a single layer film.

27. The unitary fastener of claim 1 wherein the base layer is a multilayer film.

* * * * *